US005366160A

United States Patent [19]

Balderrama

[11] Patent Number: 5,366,160

[45] Date of Patent: Nov. 22, 1994

[54] FOAMER NOZZLE WITH LOOPED RIB FLOW DISRUPTERS

[75] Inventor: Mark A. Balderrama, Colton, Calif.

[73] Assignee: Calmar Inc., City of Industry, Calif.

[21] Appl. No.: 207,610

[22] Filed: Mar. 9, 1994

[51] Int. Cl.[5] ..... B05B 7/24; B05B 11/00

[52] U.S. Cl. ..... 239/333; 239/343; 239/428.5; 239/432; 239/500; 239/504

[58] Field of Search ..... 239/333, 343, 370, 428.5, 239/432, 500, 502, 504; 222/383, 190

[56] References Cited

U.S. PATENT DOCUMENTS

| | | | |
|---|---|---|---|
| 2,754,097 | 7/1956 | Hsulian | 239/428.5 |
| 3,583,642 | 6/1971 | Crowell et al. | 239/370 X |
| 4,350,298 | 8/1980 | Tada | 239/343 X |
| 4,890,792 | 1/1990 | Martin et al. | 239/343 |
| 4,925,106 | 5/1990 | Maas et al. | 239/333 |
| 4,971,252 | 11/1990 | Tasaki et al. | 239/428.5 |
| 5,234,167 | 8/1993 | Martin | 239/432 X |

FOREIGN PATENT DOCUMENTS

| | | | |
|---|---|---|---|
| 3442901A | 6/1986 | Germany | 239/343 |

*Primary Examiner*—William Grant

*Attorney, Agent, or Firm*—Watson, Cole, Grindle & Watson

[57] ABSTRACT

A foamer nozzle for use with a trigger operated pump sprayer of the type utilized with a foamable liquid. The foaming action is optimized by maximizing the amount of mixing of the spray particles in the plume emitted from the discharge orifice of the sprayer with aspirated air. Such optimization is achieved through use of opposing pairs of individual separate and spaced apart looped ribs lying in a common plane substantially parallel to and downstream from the wall containing the discharge orifice, with each of the ribs having a tip and a pair of spaced legs which define an opening therebetween. The ribs are preferably teardrop shaped in cross-section, with the rear edges thereof being substantially V-shaped for impingement by the spray plume. In a further embodiment, an additional set of ribs are disposed in a member which is press-fit within an annular wall downstream from the first set, such that the additional set of ribs is substantially parallel to the first set, but angularly offset by about 45 degrees with respect thereto.

33 Claims, 1 Drawing Sheet

20
2
10
36
22
24
2
12
14
16
18

46
46
22
44
44
30
32
44
46
46
44

72
58
34
30
22
70
52
50
68
64
62
54
80
66
36
40
42
56
60
34
36

10
26

6
36

40
40
80"
80"
80'
36
80
36
80"
40
40
36
6

36
70
34
80'
36
36
80"
82
82
80"
7
7
84

58
40
8
56
50
60
42
62
102
80
40
42
106
54
104
100
52
70
8
60
44
40
46
22

92
90
80

70
100
80
106
80
106
106
80

FOAMER NOZZLE WITH LOOPED RIB FLOW DISRUPTERS

BACKGROUND OF THE INVENTION

The present invention relates to a foamer nozzle for use with a trigger operated pump sprayer of the type utilized with a foamable liquid. The pump sprayer is supported in a person's hand and the trigger is manually manipulated to spray foam onto a surface.

Many prior art devices have been designed for this purpose and usually include an orifice from which the foamable liquid is sprayed in a generally conical spray plume. Some sort of interrupter means is provided upon which the spray plume impinges so as to deflect and scatter the spray particles which are mixed with air entering the device through aspiration openings so as to produce foam. The construction and interrelationship of the interrupter means and the aspiration openings is critical in such devices since they cooperate in a unique manner to produce the foaming action.

It is a principal objective of the invention to provide a foamer nozzle which will optimize the foaming action by maximizing the amount of mixing of the spray particles with aspirated air in a uniform manner such that the spray foam will provide a commercially acceptable quality of foam throughout the surface area upon which the foam is sprayed.

It is also desirable to provide a foamer nozzle that can be shut off when not in use and which can be readily disposed in operative spraying position when so desired. The foamer nozzle should be durable and reliable in operation and of such construction that it can be economically manufactured.

SUMMARY OF THE INVENTION

An interrupter means of unique construction is associated with a nozzle cap of the type which is adapted to be rotated between on and off positions. The interrupter means may be combined with the nozzle cap in a unitary arrangement, or the interrupter means may be formed as a separate attachment which is adapted to be supported on the nozzle cap by suitable support means. The support means includes a plurality of support legs formed on the attachment which cooperate with a plurality of securing portions on the nozzle cap for securely supporting the attachment in place on the nozzle cap.

The disrupter means includes a passage through which liquid flows, and a plurality of ribs extend into the passage so that liquid passing through the passage impinges on the ribs. The ribs define with the passage a first plurality of openings, and the ribs are spaced from one another so as to define a second plurality of openings through which liquid can flow. The ribs are oriented within the passage in a particular manner and have a generally teardrop cross-section with the rear edge of the ribs upon which the spray plume initially impinges being a substantially V-shaped tapered edge. An annular wall is disposed outwardly of and downstream of the downstream end of the passage. In a modified form of the invention, a plurality of additional ribs are disposed downstream of a first plurality of ribs. The additional ribs increase the turbulence created by the first plurality of ribs and generate additional foam volume.

The above features of the disrupter means intercooperate with one another to optimize the foaming action. The foamable liquid spray droplets flow across the "airfoil" or tear drop shape of the ribs creating a low pressure zone downstream of the disrupter ribs. The droplets have sufficient velocity to break away from the downstream edge of the disrupter ribs into the low pressure zone, collapsing into same. The resultant turbulence produces bubble formation greater than that produced by prior interrupters of round cross-section which reduce the flow velocity by impacting the interrupters downstream face. This action produces foam of commercially acceptable quality. The disrupter means can be manufactured in an economical manner by a conventional injection molding process.

DESCRIPTION OF THE PREFERRED EMBODIMENT

Figure 1:
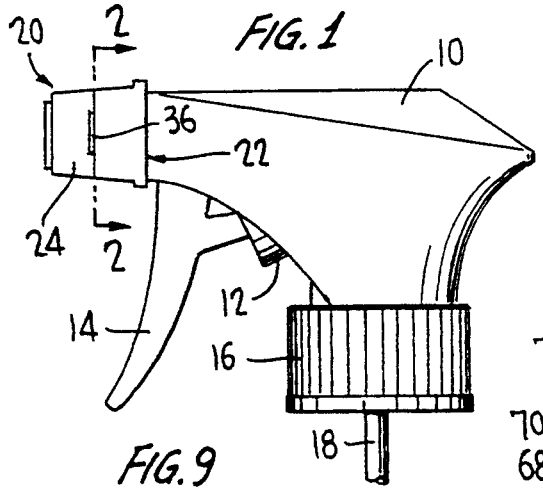
FIG. 1 is an elevation of a foamer nozzle of the invention mounted on a trigger operated pump sprayer.

Referring now to the drawings wherein like reference characters designate corresponding parts throughout the several views, there is shown in FIG. 1 a pump body 10 having a pump cylinder 12 containing a reciprocable pump piston (not shown) which is manually reciprocated by a trigger actuator 14 hingedly mounted on the pump body. A conventional threaded coupling 16 is provided for detachably connecting the pump body to a container containing foamable liquid. The usual dip tube 18 extends downwardly into the liquid so that the liquid may be drawn from the container when the trigger is manually operated.

Figure 9:
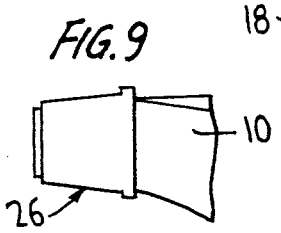
FIG. 9 is a view of a modified form of the invention wherein the nozzle cap and disrupter means are of unitary construction.

A foamer nozzle is indicated generally by reference numeral 20 in FIG. 1, the foamer nozzle including a nozzle cap 22 and disrupter means 24 in the form of a separate attachment which is supported on the nozzle cap. While the foamer nozzle is shown in FIG. 1 as being formed as two separate elements 22 and 24, it should be understood that the nozzle cap and interrupter means may be combined in a unitary foamer nozzle 26 as shown in FIG. 9. The only difference in the foamer nozzle 26 is that the disrupter means is not formed separately from the nozzle cap, and accordingly, it is not necessary to provide the interengaging support means provided on the nozzle cap and disrupter means of the foamer nozzle 20 as hereinafter described.

The nozzle cap 22 is of substantially the same construction as the nozzle cap numbered 17 in U.S. Pat. No.

4,706,888, the disclosure of which is incorporated herein by reference. Nozzle cap 22 of the present invention is adapted to cooperate with a plug element (not shown) similar to the plug numbered 16 in the aforementioned patent, the difference in construction of the plug element of the present invention being that the plug element is only provided with tangential channels, whereas in the aforementioned patent alternating radial and tangential channels are provided. In the present invention, the nozzle cap need only be rotated between on and off positions, or in other words rotated so that the internal grooves thereof corresponding to the grooves numbered 32 in the aforementioned patent are either aligned or misaligned with the channels in the plug element. However, these details of construction form no part of the invention claimed herein.

Figure 2:
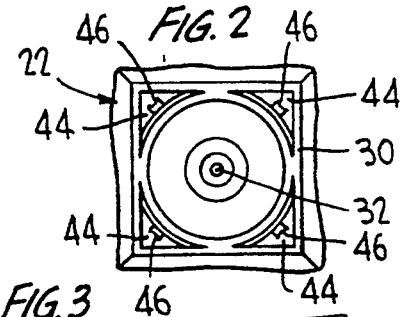
FIG. 2 is a view taken along line 2—2 of FIG. 1 with the disrupter means attachment removed.
Figure 3:
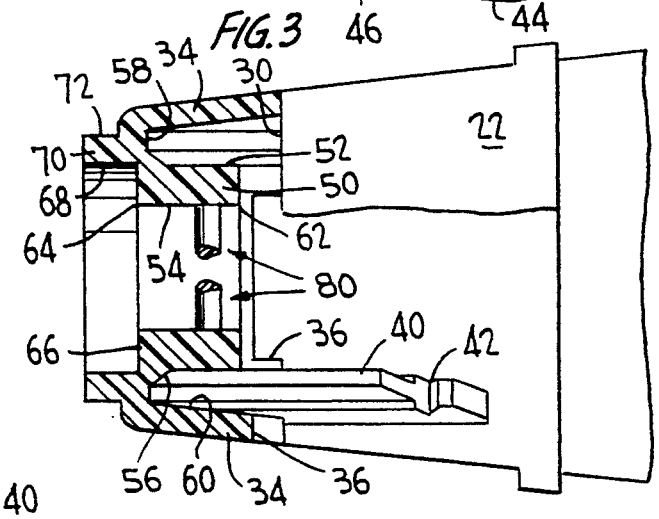
FIG. 3 is an enlarged view partly in section and partly broken away showing certain details of the disrupter means.

Referring now to FIGS. 2–5, nozzle cap 22 has an end wall 30 having a discharge orifice 32 formed in the center thereof. The disrupter means attachment 24 comprises a one-piece injected molded element formed of polypropylene. The disrupter means includes a peripheral skirt portion 34 formed around all four sides thereof, this skirt portion having cutout portions 36 which define four aspiration openings disposed at spaced peripheral portions of the foamer nozzle when the disrupter means is supported on the nozzle cap with the edge of the skirt in contact with wall 30 of the nozzle cap as shown in FIGS. 1 and 3.

Figure 4:
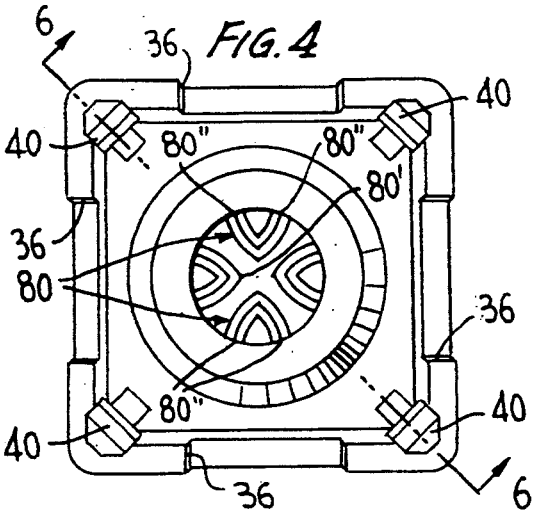
FIG. 4 is an enlarged bottom view of the disrupter means attachment.
Figure 5:
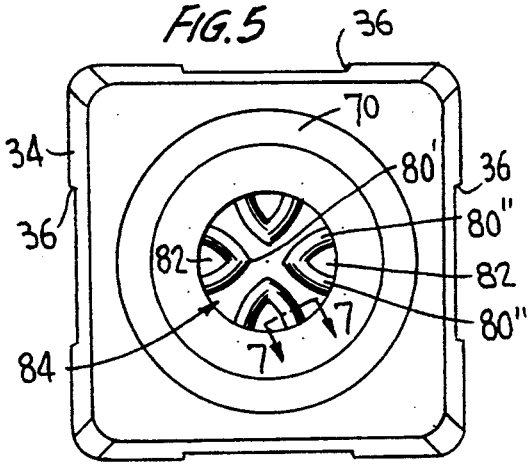
FIG. 5 is an enlarged top view of the disrupter means attachment.
Figure 6:
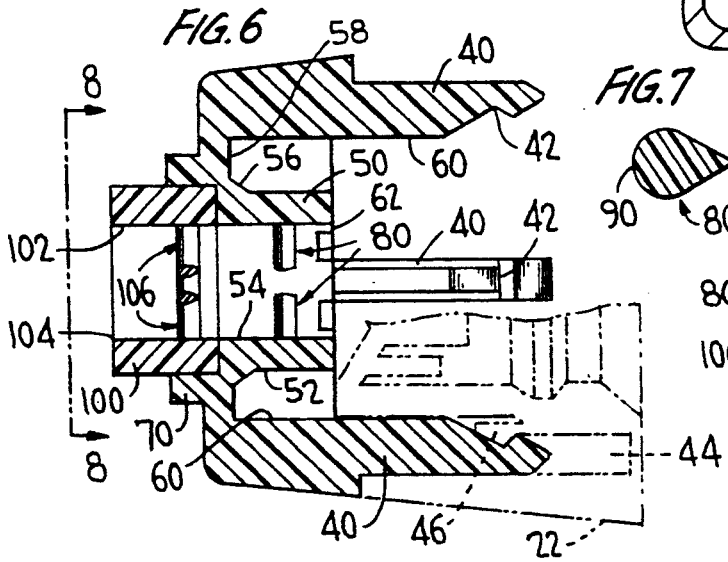
FIG. 6 is a section taken along line 6—6 of FIG. 4, showing a portion of an interconnected nozzle cap in phantom lines; this figure also shows a modified form of the invention.

Four legs 40 are formed at the four inner corners of the skirt as seen in FIG. 4, each of these legs having a notch 42 formed on the inwardly facing surface thereof as seen in FIG. 6. It should be noted at this point that FIG. 6 also illustrates an additional cylindrical member 100 which is not a component of the structure shown in FIGS. 1–5. Member 100 in combination with the components shown in FIGS. 1–5 comprises a modified form of the invention, and member 100 has been shown in FIG. 6 for the purpose of avoiding the necessity of providing a first view of the components of FIGS. 1–5 and a second view identical to the first view with member 100 mounted in place. Referring to FIG. 2, nozzle cap 22 is provided with four similar open areas 44 for receiving the four legs 40 snugly therein. As seen in FIG. 6, nozzle cap 22 is provided with a flexible projection 46 forming a securing portion in each of the open areas 44 which is adapted to snap into the notch 42 in an associated leg 40 when the attachment is pushed into operative position to thereby securely support the attachment on the nozzle cap.

The disrupter means attachment includes a central portion 50 having an outer surface 52 and an inner surface 54. Outer surface 52 joins with a frusto-conical surface 56 which joins with an annular surface 58 which joins with the inner surface 60 of the skirt 40. Inner surface 54 is cylindrical and has a longitudinal axis which is concentric with the orifice 32. Surface 54 defines a passage through which liquid flows, the passage having an upstream end 62 and a downstream end 64 relative to the flow of the spray plume which is discharged from orifice 32 as a generally conical spray which passes through the passage. An annular surface 66 extends radially outwardly from the downstream end of the passage and joins with the inner surface 68 of an annular wall 70 having an outer surface 72. The annular wall is therefore disposed outwardly of and downstream of the downstream end of the passage.

Four similar ribs 80 define opposing pairs of individual looped ribs which lie in a common plane substantially parallel with wall 30 having the orifice therein and substantially perpendicular to the axis of the passage defined by surface 54. The opposite ends of the ribs are formed integral with inner surface 54, and as seen in FIGS. 4 and 5, each rib is of generally arched configuration including a tip 80' and a pair of spaced legs 80" defining with surface 54 an opening 82, there being four of such openings defined by the four ribs. The ribs are spaced from one another to define further openings or open spaces 84 therebetween, such that an open space is defined adjacent the axis of the passage through which the liquid flows. All of spaces 84 cooperate to generally define a cross formee as seen most clearly in FIG. 5.

Figure 7:
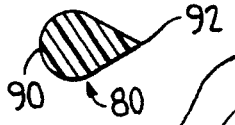
FIG. 7 is an enlarged cross-section taken along line 7—7 of FIG. 5.

The tips 80' of the ribs lie tangent to a circle of predetermined diameter coaxial with the discharge orifice; and the ends of the legs where they join surface 54 lie in a circle which is coaxial with said aforementioned circle and having a diameter which is greater than said predetermined diameter. Ribs 80 have a teardrop shaped cross-section as seen in FIG. 7 with the front edge 90 of each rib being rounded and the rear edge 92 of each rib being tapered so that the rear edge is substantially V-shaped. The ribs are disposed near to but spaced from the upstream end 62 of the passage and remote from the downstream end 64. It is noted that the distance of the ribs from the downstream end is much greater than the distance from the upstream end.

Figure 8:
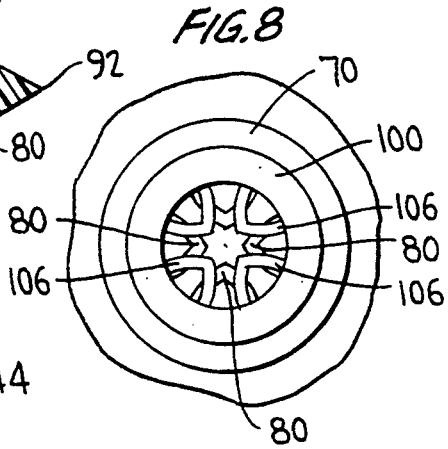
FIG. 8 is a view taken along line 8—8 of FIG. 6 of the modified form of the invention.

Referring to FIGS. 6 and 8, a modified form of the invention is illustrated wherein additional disrupter means is provided. A generally cylindrical member 100 is press-fitted within annular wall 70 to securely mount it in the position shown. Member 100 has a cylindrical inner surface 102 which is aligned with surface 54 to provide a passage through which foamable liquid flows, the downstream end of the passage in this modified version being identified by reference numeral 104. Four similar ribs 106 are identical in construction with ribs 80 previously described and have the opposite ends thereof formed integral with surface 102. Ribs 106 lie in a common plane which is substantially parallel with the plane within which ribs 80 lie. The relationship of ribs 106 to one another and the associated surface 102 are the same as those of ribs 80 to one another and the associated surface 54. Ribs 106, of course, have the same teardrop shaped cross-section as ribs 80 which is shown in FIG. 7. The ribs 106 are angularly offset about the longitudinal axis of the passage through which the foamable liquid flows with respect to the ribs ribs 80. The angular offset is preferably about 45 degrees as seen in FIG. 8.

The invention has been described with reference to a preferred embodiment. Obviously, various modifications, alterations and other embodiments will occur to others upon reading and understanding this specification. It is my intention to include all such modifications, alterations and alternate embodiments insofar as they come within the scope of the appended claims or the equivalent thereof.

What is claimed is:

1. A foamer nozzle for a trigger operated pump sprayer comprising, a wall containing a discharge orifice, a foam generating means extending outwardly of said wall and including disrupter means for disrupting spray of foamable liquid discharged from said orifice as a generally conical spray plume, said foam generating means having air aspiration openings in communication with said disrupter means, said disrupter means lying in the path of the spray plume, said disrupter means comprising opposing pairs of individual looped ribs lying in a common plane substantially parallel to and spaced from said wall containing said discharge orifice, each of said ribs having a tip and a pair of spaced legs defining an opening between said legs, each of said ribs being spaced apart and separate from an adjacent rib to define further openings between adjacent ribs, and each of said ribs presenting rear edges against which the spray plume impinges to disrupt and deflect spray particles mixed with air entering the aspiration openings to generate foam.

2. A foamer nozzle as defined in claim 1, wherein said tips lie tangent to a circle of predetermined diameter coaxial with said discharge orifice, and ends of said legs lying in a circle coaxial with said first mentioned circle and having a diameter which is greater than said predetermined diameter.

3. A foamer nozzle as defined in claim 1, wherein said ribs have a teardrop shaped cross-section with said rear edges thereof being substantially V-shaped.

4. A foamer nozzle as defined in claim 1 wherein said disrupter means comprises a separate attachment, said foamer nozzle including a nozzle cap, and support means for supporting said attachment on said nozzle cap.

5. A foamer nozzle as defined in claim 4 wherein said support means includes a plurality of support legs formed on said attachment, said nozzle cap having a plurality of spaced securing portions for engaging said support legs.

6. A foamer nozzle as defined in claim 1 including additional disrupter means, said additional disrupter means comprising opposing pairs of individual looped ribs lying in a common plane substantially parallel with said first-mentioned common plane and downstream thereof relative to the flow of foamable liquid through the nozzle, each of the ribs of said additional disrupter means having a tip and a pair of spaced legs defining an opening therebetween, said ribs of said additional disrupter means being spaced apart to define further openings therebetween, said ribs of said additional disrupter means presenting rear edges against which the foamable liquid impinges to increase turbulence and generate additional foam volume.

7. A foamer nozzle as defined in claim 6 wherein the ribs of said additional disrupter means are angularly offset relative to the ribs of said first-mentioned disrupter means.

8. A foamer nozzle for a trigger operated pump sprayer comprising, means defining a discharge orifice, foam generating means extending outwardly of said orifice and including disrupter means for disrupting a spray of foamable liquid discharged from said orifice as a generally conical spray plume, said foam generating means having air aspiration means providing communication between ambient air and said disrupter means, said disrupter means being disposed in the path of the spray plume so that the spray plume impinges upon the disrupter means as it passes therethrough to disrupt and deflect spray particles mixed with air passing through said aspiration means to generate foam, said disrupter means comprising an inner surface defining a passage through which liquid flows, said passage having a longitudinal axis, a plurality of ribs disposed within said passage and spaced from one another, said ribs being of generally arched configuration each of which defines with said inner surface an opening, and each of said ribs being separate and spaced from one another so as to define an open space adjacent the longitudinal axis of said passage.

9. A foamer nozzle as defined in claim 8 wherein said air aspiration means includes a plurality of openings disposed at spaced peripheral portions of said nozzle.

10. A foamer nozzle as defined in claim 8 wherein said ribs are spaced from one another so as to define between adjacent ribs additional open spaces which are in communication with said first-mentioned open space.

11. A foamer nozzle as defined in claim 10 wherein all of said open spaces cooperate to generally define a cross formee.

12. A foamer nozzle as defined in claim 8 wherein said ribs are disposed generally in a plane extending perpendicular to said axis.

13. A foamer nozzle as defined in claim 8 wherein said passage has an upstream end and a downstream end relative to the spray plume passing therethrough, said ribs being disposed near to but spaced from said upstream end and disposed remote from said downstream end.

14. A foamer nozzle as defined in claim 8 wherein said passage has an upstream end and a downstream end relative to the spray plume passing therethrough, said nozzle including an annular wall formed thereon outwardly of and downstream of the downstream end of said passage.

15. A foamer nozzle as defined in claim 8 wherein said disrupter means comprises a separate attachment, said foamer nozzle including a nozzle cap, and support means for supporting said attachment on said nozzle cap, said support means including a plurality of support legs formed on said attachment, said nozzle cap having a plurality of spaced securing portions for engaging said support legs.

16. A foamer nozzle as defined in claim 8 wherein each of said ribs has a generally teardrop shaped cross-section including a tapered edge comprising the portion of each rib upon which the spray plume initially impinges.

17. A foamer nozzle as defined in claim 8 including additional disrupter means comprising a plurality of additional ribs disposed within said passage downstream of said first-mentioned plurality of ribs relative to the flow of foamable liquid through the nozzle, said additional ribs being spaced from one another and being of generally arched configuration each of which defines with said inner surface an opening, said additional ribs being spaced from one another so as to define an open space adjacent the axis of said passage.

18. A foamer nozzle as defined in claim 17 wherein said additional ribs of said additional disrupter means are angularly offset relative to the ribs of said first-mentioned disrupter means.

19. A foamer nozzle as defined in claim 17 wherein said first-mentioned ribs are disposed generally in a plane extending perpendicular to said axis, said additional ribs being disposed generally in a plane parallel to said first-mentioned plane.

20. A foamer nozzle as defined in claim 17 wherein said passage has an upstream end and a downstream end relative to the flow of foamable liquid therethrough, said first-mentioned ribs being disposed near to but spaced from said upstream end and disposed remote from said downstream end, said additional ribs being disposed near to but spaced from said downstream end and being disposed remote from said upstream end.

21. A foamer nozzle as defined in claim 17 wherein said nozzle has an upstream end and a downstream end relative to the flow of foamable liquid through the nozzle, said nozzle including an annular wall formed thereon outwardly of and downstream of the downstream end of said passage, and a generally cylindrical member supported by said annular wall, said cylindrical member having a passage therethrough aligned with said first-mentioned passage, said additional ribs being disposed within the passage through said cylindrical member.

22. A foamer nozzle as defined in claim 17 wherein each of said ribs has a generally teardrop shaped cross-section including a tapered edge comprising the portion of each rib upon which the foamable liquid initially impinges.

23. A foamer nozzle for a trigger operated pump sprayer comprising, means defining a discharge orifice, foam generating means extending outwardly of said orifice and including disrupter means for disrupting a spray of foamable liquid discharged from said orifice as a generally conical spray plume, said foam generating means having air aspiration means providing communication between ambient air and said disrupter means, said disrupter means being disposed in the path of the spray plume so that the spray plume impinges upon the disrupter means as it passes therethrough to disrupt and deflect spray particles mixed with air passing through said aspiration means to generate foam, said disrupter means having an inner cylindrical surface defining a passage through which liquid flows, a plurality of ribs, each of said ribs having two ends and a central apex and having the ends thereof formed integral with said inner surface to define with said surface an opening, the central apex of each of said ribs extending into said passage and being separate and spaced from one another to define further openings therebetween.

24. A foamer nozzle as defined in claim 23 wherein said further openings cooperate to generally define the configuration of a cross formee.

25. A foamer nozzle as defined in claim 23 wherein said means defining a discharge orifice is disposed in a first plane, said ribs being disposed in a plane substantially parallel with said first plane.

26. A foamer nozzle as defined in claim 23 wherein said passage has an upstream end and a downstream end relative to the spray plume passing therethrough, said ribs being disposed a distance from said downstream end which is much greater than the distance from said upstream end, said nozzle including an annular wall disposed outwardly of and downstream of the downstream end of said passage.

27. A foamer nozzle as defined in claim 23 wherein said disrupter means comprises a separate attachment, said foamer nozzle including a nozzle cap, and support means for supporting said attachment on said nozzle cap, said support means including a plurality of support legs formed on said attachment, said nozzle cap having a plurality of spaced securing portions for engaging said support legs.

28. A foamer nozzle as defined in claim 23 wherein each of said ribs has a generally teardrop shaped cross-section including a tapered edge comprising the portion of each rib upon which the spray plume initially impinges.

29. A foamer nozzle as defined in claim 23 including additional disrupter means comprising an additional inner cylindrical surface aligned with said first-mentioned cylindrical surface and defining an additional passage aligned with said first-mentioned passage, a plurality of additional ribs each of which having two ends and a central apex and has the ends thereof formed integral with said additional inner surface to defined therewith an opening, said additional ribs extending into said additional passage and being spaced from one another to define further openings therebetween.

30. A foamer nozzle as defined in claim 29 wherein said additional ribs of said additional disrupter means are angularly offset relative to the ribs of said first-mentioned disrupter means.

31. A foamer nozzle as defined in claim 29 wherein said means defining a discharge orifice is disposed in a first plane, said first-mentioned ribs being disposed in a plane substantially parallel with said first plane, said additional ribs being disposed in a plane substantially parallel with said first plane and being disposed downstream of said first-mentioned ribs relative to the flow of foamable liquid through said nozzle.

32. A foamer nozzle as defined in claim 29 wherein said nozzle has an upstream end and a downstream end relative to the flow of foamable liquid through the nozzle, said nozzle including an annular wall formed thereon outwardly of and downstream of the downstream end of said passage, and a generally cylindrical member supported by said annular wall, said cylindrical member having a passage therethrough aligned with said first-mentioned passage, said additional ribs being disposed within the passage through said cylindrical member.

33. A foamer nozzle as defined in claim 29 wherein each of said ribs has a generally teardrop shaped cross-section including a tapered edge comprising the portion of each rib upon which the foamable liquid initially impinges.

* * * * *